US006159917A

United States Patent [19]

Baran, Jr. et al.

[11] Patent Number: 6,159,917

[45] Date of Patent: Dec. 12, 2000

[54] DRY CLEANING COMPOSITIONS CONTAINING HYDROFLUOROETHER

[75] Inventors: Jimmie R. Baran, Jr., Woodbury; John C. Newland, White Bear Lake, both of Minn.

[73] Assignee: 3M Innovative Properties Company, St. Paul, Minn.

[21] Appl. No.: 09/213,023

[22] Filed: Dec. 16, 1998

[51] Int. Cl.[7] ..... D06L 1/02; C11D 7/26; C11D 7/28

[52] U.S. Cl. ..... 510/291; 510/285; 510/412; 510/506; 8/142

[58] Field of Search ..... 510/285, 505, 510/506, 412, 291, 286; 8/142

[56] References Cited

U.S. PATENT DOCUMENTS

| | | | |
|---|---|---|---|
| 3,453,333 | 7/1969 | Litt et al. | 568/684 |
| 3,772,195 | 11/1973 | Francen | 252/8.05 |
| 3,778,381 | 12/1973 | Rosano et al. | 516/67 |
| 3,900,372 | 8/1975 | Childs et al. | 205/430 |
| 4,090,967 | 5/1978 | Falk | 252/3 |
| 4,099,574 | 7/1978 | Cooper et al. | 169/47 |
| 4,242,516 | 12/1980 | Mueller | 546/248 |
| 4,272,615 | 6/1981 | Yoneyama et al. | 430/527 |
| 4,359,096 | 11/1982 | Berger | 169/44 |
| 4,383,929 | 5/1983 | Bertocchio et al. | 252/8.05 |
| 4,472,286 | 9/1984 | Falk | 252/3 |
| 4,536,298 | 8/1985 | Kamei et al. | 252/8.05 |
| 4,722,904 | 2/1988 | Feil | 516/67 |
| 4,795,764 | 1/1989 | Alm et al. | 521/107 |
| 4,975,468 | 12/1990 | Yiv | 514/759 |
| 4,983,769 | 1/1991 | Bertocchio et al. | 564/96 |
| 4,987,154 | 1/1991 | Long, Jr. | 514/772 |
| 5,085,786 | 2/1992 | Alm et al. | 252/8.05 |
| 5,275,669 | 1/1994 | Van Der Puy et al. | 134/42 |
| 5,558,853 | 9/1996 | Quay | 424/9.5 |
| 5,610,128 | 3/1997 | Zyhowski et al. | 510/288 |
| 5,658,962 | 8/1997 | Moore et al. | 521/114 |
| 5,667,772 | 9/1997 | Zastrow et al. | 424/18.02 |
| 5,674,825 | 10/1997 | Buchwald et al. | 510/177 |
| 5,750,797 | 5/1998 | Vitcak et al. | 568/683 |
| 5,756,002 | 5/1998 | Chen et al. | 252/364 |
| 5,827,446 | 10/1998 | Merchant et al. | 252/67 |
| 5,827,812 | 10/1998 | Flynn et al. | 510/411 |
| 6,008,179 | 12/1999 | Flynn et al. | 510/411 |

FOREIGN PATENT DOCUMENTS

| | | |
|---|---|---|
| 2098057 | 12/1993 | Canada . |
| 0 051 526 A1 | 5/1982 | European Pat. Off. . |
| 0 450 855 A2 | 10/1991 | European Pat. Off. . |
| 0450855 | 10/1991 | European Pat. Off. . |
| 2 287 432 | 11/1976 | France . |
| 1 294 949 | 5/1969 | Germany . |
| 2-202599 | 8/1990 | Japan . |
| 9-111653 | 4/1997 | Japan . |
| 10-18176 | 1/1998 | Japan . |
| 10-212498 | 8/1998 | Japan . |
| WO 93/11280 | 6/1993 | WIPO . |
| WO 93/11868 | 6/1993 | WIPO . |
| WO 94/19101 | 9/1994 | WIPO . |
| WO 95/31965 | 11/1995 | WIPO . |
| 96/22356 | 7/1996 | WIPO . |
| WO 96/22356 | 7/1996 | WIPO . |
| WO 96/40057 | 12/1996 | WIPO . |
| WO 97/33563 | 9/1997 | WIPO . |
| WO 98/59105 | 12/1998 | WIPO . |

OTHER PUBLICATIONS

P. S. Zurer, "Looming Ban on Production of CFCs, Halons Spurs Switch to Substitutes," *Chemical & Engineering News*, pp. 12–18, Nov. 15, 1993.

Yamashita et al., International Conference on CFC and BFC (Halons), Shanghai, China, Aug. 7–10, 1994, pp. 55–58.

Chemical Abstracts, AN 129:42528, "Testing and qualification of HFE cleaning agents in vapor degreasing applications", Hayes et al, 1997.

*Primary Examiner*—Christine Skane
*Attorney, Agent, or Firm*—Scott A. Bardell

[57] ABSTRACT

The invention provides dry cleaning compositions comprising hydrofluoroether, a cosolvent selected from the group consisting of glycol ethers, fluorocarbon surfactants, alkanols, and mixtures thereof, and water present in an amount of less than 1 percent by weight. In another aspect, the invention provides a method of cleaning fabric articles comprising the step of contacting an effective amount of the above dry cleaning composition with a fabric for a length of time sufficient to clean the article.

17 Claims, No Drawings

DRY CLEANING COMPOSITIONS CONTAINING HYDROFLUOROETHER

BACKGROUND OF THE INVENTION

This invention relates to dry cleaning compositions and particularly to dry cleaning compositions containing hydrofluoroethers.

Solvent cleaning applications where contaminated articles are immersed in (or washed with) solvent liquids and/or vapors are well known. Applications involving one or more stages of immersion, rinsing, and/or drying are common. Solvents can be used at ambient temperature (often, accompanied by ultrasonic agitation) or at elevated temperatures up to the boiling point of the solvent.

A major concern in solvent cleaning is the tendency (especially where solvent is used at an elevated temperature) for solvent vapor loss from the cleaning system into the atmosphere. Although care is generally exercised to minimize such losses (for example, through good equipment design and vapor recovery systems), most practical cleaning applications result in some loss of solvent vapor into the atmosphere.

Solvent cleaning processes have traditionally utilized chlorinated solvents (for example, chlorofluorocarbons, such as 1,1,2-trichloro-1,2,2-trifluoroethane, and chlorocarbons, such as 1,1,1-trichloroethane) alone or in admixture with one or more cosolvents such as aliphatic alcohols or other low molecular weight, polar compounds. Such solvents were initially believed to be environmentally-benign, but have now been linked to ozone depletion. According to the Montreal Protocol and its attendant amendments, production and use of the solvents must be discontinued (see, for example, P. S. Zurer, "Looming Ban on Production of CFCs, Halons Spurs Switch to Substitutes," *Chemical & Engineering News,* page 12, Nov. 15, 1993).

Thus, there has developed a need in the art for substitutes or replacements for the commonly-used cleaning solvents. Such substitutes should have a low ozone depletion potential, should have boiling ranges suitable for a variety of solvent cleaning applications, and should have the ability to dissolve both hydrocarbon-based, fluorocarbon-based soils as well as aqueous based stains. Preferably, substitutes will also be low in toxicity, have no flash points (as measured by ASTM D3278-89), have acceptable stability for use in cleaning applications, and have short atmospheric lifetimes and low global warming potentials.

Partially-fluorinated ethers have been suggested as chlorofluorocarbon alternatives (see, for example, Yamashita et al., International Conference on CFC and BFC (Halons), Shanghai, China, Aug. 7–10, 1994, pages 55–58).

European Patent Publication No. 0 450 855 A2 (Imperial Chemical Industries PLC) describes the use of low molecular weight, fluorine-containing ethers of boiling point 20°–120° C. in solvent cleaning applications.

International Patent Publication No. WO 93/11280 (Allied-Signal, Inc.) discloses a non-aqueous cleaning process which utilizes a fluorocarbon-based rinsing solvent.

U.S. Pat. No. 5,275,669 (Van Der Puy et al.) describes hydrofluorocarbon solvents useful for dissolving contaminants or removing contaminants from the surface of a substrate. The solvents have 4 to 7 carbon atoms and have a portion which is fluorocarbon, the remaining portion being hydrocarbon.

U.S. Pat. No. 3,453,333 (Litt et al.) discloses fluorinated ethers containing at least one halogen substituent other than fluorine and states that those ethers which are liquid can be used as solvents for high molecular weight resinous perhalogenated compounds such as solid polychlorotrifluoroethylene resins.

French Patent Publication No. 2,287,432 (Societe Nationale des Poudres et Explosifs) describes new partially-fluorinated ethers and a process for their preparation. The compounds are said to be useful as hypnotic and anesthetic agents; as monomers for preparing heat-stable, fire-resistant, or self-lubricant polymers; and in phyto-sanitary and phyto-pharmaceutical fields.

German Patent Publication No. 1,294,949 (Farbwerke Hoechst AG) describes a technique for the production of perfluoroalkyl-alkyl ethers, said to be useful as narcotics and as intermediates for the preparation of narcotics and polymers.

SUMMARY OF THE INVENTION

In one aspect, the invention provides dry cleaning compositions comprising hydrolluoroether, a cosolvent selected from the group consisting of glycol ethers, fluorocarbon surfactants, alkanes, alkanols, and mixtures thereof, and water present in an amount of less than 1 percent by weight. In another aspect, the compositions of the invention provide a dry cleaning composition comprising hydrofluoroether, a cosolvent selected from the group consisting of glycol ethers, alkanols, fluorocarbon surfactants, and mixtures thereof, water present in an amount of less than 1 percent by weight, and a detergent. In another aspect, the invention provides a method of cleaning fabric articles comprising the step of contacting an effective amount of either of the above dry cleaning compositions with a fabric for a length of time sufficient to clean the article.

The dry cleaning compositions of the invention are generally less aggressive toward fabrics than perchloroethylene, allowing its use with a wider variety of fabrics. The compositions of the invention also dry faster than perchloroethylene systems.

Homogeneous compositions are preferred in the practice of the invention, but inhomogeneous formulations such as liquid/liquid emulsions may also be used.

DETAILED DESCRIPTION OF THE INVENTION

Hydrofluoroethers (HFEs) suitable for use in the process are generally low polarity chemical compounds minimally containing carbon, fluorine, hydrogen, and catenary (that is, in-chain) oxygen atoms. HFEs can optionally contain additional catenary heteroatoms, such as nitrogen and sulfur. HFEs have molecular structures which can be linear, branched, or cyclic, or a combination thereof (such as alkylcycloaliphatic), and are preferably free of ethylenic unsaturation, having a total of about 4 to about 20 carbon atoms. Such HFEs are known and are readily available, either as essentially pure compounds or as mixtures.

Preferred hydrofluoroethers can have a boiling point in the range from about 40° C. to about 275° C., preferably from about 50° C. to about 200° C., even more preferably from about 50° C. to about 121° C. Preferably, the HFEs of the invention have a higher vapor pressure than that of perchloroethylene, thus decreasing the dry time of the cleaned fabric.

It is very desirable that the hydrofluoroether be non-flammable. To be non-flammable, the relationship between the fluorine, hydrogen and carbon atoms of the HFE should meet the requirements of Equation I.

Equation I $$\#\text{ of F atoms}/(\#\text{ H atoms}+\#\text{ C—C bonds})\geqq 0.8$$

For example, the calculation for $C_4F_9OCH_3$ is 9/(3+3)=1.5. Therefore, this compound is nonflammable and clearly is very useful in this invention. In contrast, the calculation for $C_3F_7OC_3H_7$, is 7/(7+4)=0.64 meaning that $C_3F_7OC_3H_7$ is flammable and not particularly useful in this invention. In general, increasing the number of fluorine atoms, decreasing the number of hydrogen atoms, or decreasing the number of carbon—carbon bonds each increases the flash point of the HFE.

Additionally, the HFEs can be relatively low in toxicity, can have very low ozone depletion potentials, for example, zero, have short atmospheric lifetimes, and have low global warming potentials relative to chlorofluorocarbons and many chlorofluorocarbon substitutes.

Useful hydrofluoroethers include two varieties: segregated hydrofluoroethers and omega-hydrofluoroalkylethers. Structurally, the segregated hydrofluoroethers comprise at least one mono-, di-, or trialkoxy-substituted perfluoroalkane, perfluorocycloalkane, perfluorocycloalkyl-containing perfluoroalkane, or perfluorocycloalkylene-containing perfluoroalkane compound.

Such HFEs are described in WO 96/22356 and are represented below in Formula I:

$$R_f—(O—R_h)_x \qquad \text{(Formula I)}$$

wherein:

x is from 1 to about 3;

when x is 1, $R_f$ is selected from the group consisting of linear or branched perfluoroalkyl groups having from 2 to about 15 carbons, perfluorocycloalkyl groups having from 3 to about 12 carbon atoms, and perfluorocycloalkyl-containing perfluoroalkyl groups having from 5 to about 15 carbon atoms;

when x is 2, $R_f$ is selected from the group consisting of linear or branched perfluoroalkanediyl groups or perfluoroalkylidene groups having from 2 to about 15 carbon atoms, perfluorocycloalkyl- or perfluorocycloalkylene-containing perfluoroalkanediyl or perfluoroalkylidene groups having from 6 to about 15 carbon atoms, and perfluorocycloalkylidene groups having from 3 to about 12 carbon atoms;

when x is 3, $R_f$ is selected from the group consisting of linear or branched perfluoroalkanetriyl groups or perfluoroalkylidene groups having from 2 to about 15 carbon atoms, perfluorocycloalkyl- or perfluorocycloalkylene-containing perfluoroalkanetriyl or perfluoroalkylidene groups, having from 6 to about 15 carbon atoms, and perfluorocycloalkanetriyl groups having from 3 to about 12 carbon atoms;

in all cases, $R_f$ can be optionally terminated with an $F_5S$-group;

each $R_h$ is independently selected from the group consisting of linear or branched alkyl groups having from 1 to about 8 carbon atoms, cycloalkyl-containing alkyl groups having from 4 to about 8 carbon atoms, and cycloalkyl groups having from 3 to about 8 carbon atoms;

wherein either or both of the groups $R_f$ and $R_h$ can optionally contain one or more catenary heteroatoms; and wherein the sum of the number of carbon atoms in the $R_f$ group and the number of carbon atoms in the $R_h$ group(s) is greater or equal to 4; and wherein the perfluorocycloalkyl and perfluorocycloalkylene groups contained within the perfluoroalkyl, perfluoroalkanediyl, perfluoroalkylidene and perfluoroalkanetriyl groups can optionally and independently be substituted with, for example, one or more perfluoroalkyl groups having from 1 to about 4 carbon atoms.

Preferably, x is 1; $R_f$ is defined as above; $R_h$ is an alkyl group having from 1 to about 6 carbon atoms; $R_f$ but not $R_h$ can contain one or more catenary heteroatoms; and the sum of the number of carbon atoms in $R_f$ and the number of carbon atoms in $R_h$ is greater than or equal to 4. Even more preferably, x is 1; $R_f$ is selected from the group consisting of linear or branched perfluoroalkyl groups having from 3 to about 8 carbon atoms, perfluorocycloalkyl-containing perfluoroalkyl or perfluoroalkylidene groups having from 5 to about 8 carbon atoms, and perfluorocycloalkyl groups having from 5 to about 6 carbon atoms; $R_h$ is an alkyl group having from 1 to about 3 carbon atoms; and $R_f$ but not $R_h$ can contain one or more catenary heteroatoms. The perfluoroalkyl and perfluorocycloalkylene groups contained within the perfluoroalkyl, perfluoroalkanediyl, perfluoroalkylidene, and perfluoroalkanetriyl groups can optionally and independently be substituted with, for example, one or more perfluoromethyl groups.

Representative hydrofluoroether compounds described by Formula I include the following:

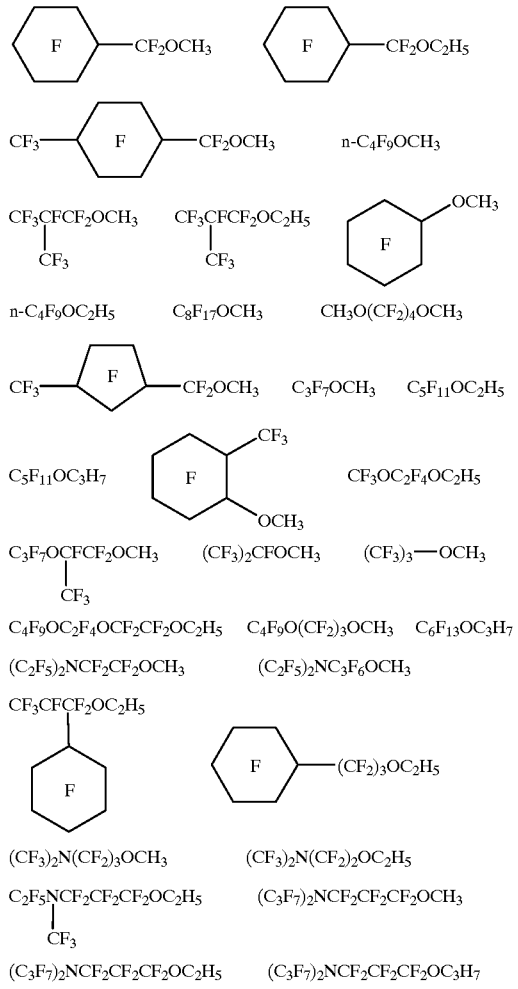

-continued

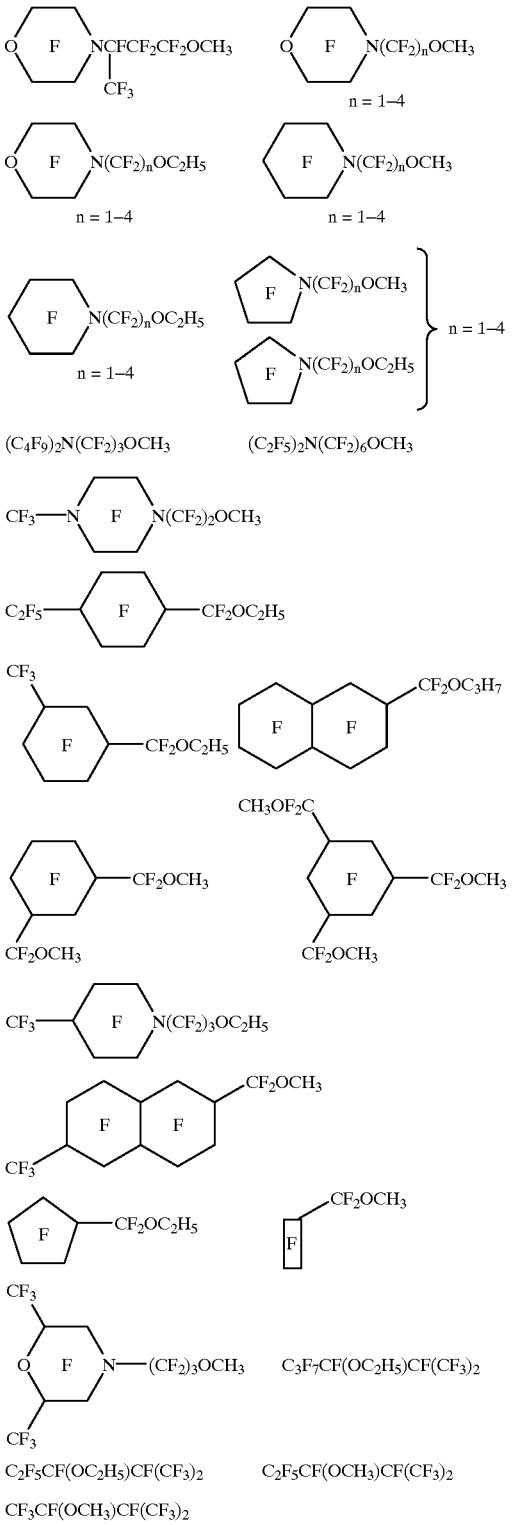

wherein cyclic structures designated with an interior "F" are perfluorinated.

Preferred segregated hydrofluoroethers include n-$C_3F_7OCH_3$, $(CF_3)_2CFOCH_3$, n-$C_4F_9OCH_3$, $(CF_3)_2CFCF_2OCH_3$, n-$C_4F_9OC_2H_5$, $(CF_3)_2CFCF_2OC_2H_5$, $(CF_3)_3COCH_3$, $CH_3)(CF_2)_4OCH_3$, and $CH_3O(CF_2)_6OCH_3$.

Segregated hydrofluoroethers (that is, HFEs described generally by Formula I) can be prepared by alkylation of perfluorinated alkoxides prepared by the reaction of the corresponding perfluorinated acyl fluoride or perfluorinated ketone with an anhydrous alkali metal fluoride (for example, potassium fluoride or cesium fluoride) or anhydrous silver fluoride in an anhydrous polar aprotic solvent. (See, for example, the preparative methods described in French Patent Publication No. 2,287,432 and German Patent Publication No. 1,294,949, supra). Alternatively, a fluorinated tertiary alcohol can be allowed to react with a base (for example, potassium hydroxide or sodium hydroxide) to produce a perfluorinated tertiary alkoxide which can then be alkylated by reaction with alkylating agent, such as described in U.S. Pat. No. 5,750,797, which is herein incorporated by reference.

Suitable alkylating agents for use in the preparation of segregated hydrofluoroethers include dialkyl sulfates (for example, dimethyl sulfate), alkyl halides (for example, methyl iodide), alkyl p-toluene sulfonates (for example, methyl p-toluenesulfonate), alkyl perfluoroalkanesulfonates (for example, methyl perfluoromethanesulfonate), and the like. Suitable polar aprotic solvents include acyclic ethers such as diethyl ether, ethylene glycol dimethyl ether, and diethylene glycol dimethyl ether; carboxylic acid esters such as methyl formate, ethyl formate, methyl acetate, diethyl carbonate, propylene carbonate, and ethylene carbonate; alkyl nitrites such as acetonitrile; alkyl amides such as N,N-dimethylformamide, N,N-diethylformamide, and N-methylpyrrolidone; alkyl sulfoxides such as dimethyl sulfoxide; alkyl sulfones such as dimethylsulfone, tetramethylene sulfone, and other sulfolanes; oxazolidones such as N-methyl-2-oxazolidone; and mixtures thereof.

Suitable perfluorinated acyl fluorides can be prepared by electrochemical fluorination (ECF) of the corresponding hydrocarbon carboxylic acid (or a derivative thereof), using either anhydrous hydrogen fluoride (Simons ECF) or $KF_2$.HF (Phillips ECF) as the electrolyte. Perfluorinated acyl fluorides and perfluorinated ketones can also be prepared by dissociation of perfluorinated carboxylic acid esters (which can be prepared from the corresponding hydrocarbon or partially-fluorinated carboxylic acid esters by direct fluorination with fluorine gas). Dissociation can be achieved by contacting the perfluorinated ester with a source of fluoride ion under reacting conditions (see the method described in U.S. Pat. No. 3,900,372 (Childs), the description of which is incorporated herein by reference) or by combining the ester with at least one initiating reagent selected from the group consisting of gaseous, nonhydroxylic nucleophiles; liquid, non-hydroxylic nucleophiles; and mixtures of at least one non-hydroxylic nucleophile (gaseous, liquid, or solid) and at least one solvent which is inert to acylating agents.

Initiating reagents which can be employed in the dissociation are those gaseous or liquid, non-hydroxylic nucleophiles and mixtures of gaseous, liquid, or solid, nonhydroxylic nucleophile(s) and solvent (hereinafter termed "solvent mixtures") which are capable of nucleophilic reaction with perfluorinated esters. The presence of small amounts of hydroxylic nucleophiles can be tolerated. Suitable gaseous or liquid, nonhydroxylic nucleophiles include dialkylamines, trialkylamines, carboxamides, alkyl sulfoxides, amine oxides, oxazolidones, pyridines, and the like, and mixtures thereof. Suitable non-hydroxylic nucleophiles for use in solvent mixtures include such gaseous or liquid, non-hydroxylic nucleophiles, as well as solid, non-hydroxylic nucleophiles, for example, fluoride, cyanide, cyanate, iodide, chloride, bromide, acetate, mercaptide, alkoxide, thiocyanate, azide, trimethylsilyl difluoride, bisulfite, and bifluoride anions, which can be used in the form of alkali metal, ammonium, alkyl-substituted ammonium (mono-. di-, tri-, or tetra-substituted), or quaternary phosphonium salts, and mixtures thereof. Such salts are in general commercially available but, if desired, can be prepared by known methods, for example, those described by M. C. Sneed and R. C. Brasted in *Comprehensive Inorganic Chemistry,* Volume Six (The Alkali Metals), pages 61–64, D. Van Nostrand Company, Inc., New York (1957), and by H. Kobler et al. in Justus Liebigs Ann. Chem. 1978, 1937. 1,4-diazabicyclo[2.2.2]octane and the like are also suitable solid nucleophiles.

Other useful hydrofluoroethers are the omega-hydrofluoroalkyl ethers described in U.S. Pat. No. 5,658,962 (Moore et al.), herein incorporated by reference, which can be described by the general structure shown in Formula II:

$$X—R_f'—(O—R_f'')_y—O—R''—H \quad \text{(Formula II)}$$

wherein:

X is either F or H;

$R_f'$ is a divalent perfluorinated organic radical having from 1 to about 12 carbon atoms;

$R_f$ is a divalent perfluorinated organic radical having from 1 to about 6 carbon atoms;

R" is a divalent organic radical having from 1 to 6 carbon atoms, and preferably, R" is perfluorinated; and y is an integer from 0 to 4;

with the proviso that when X is F and y is 0, R" contains at least one F atom.

Representative compounds described by Formula II which are suitable for use in the processes of the invention include the following compounds:

$C_4F_9OC_2F_4H$
$HC_3F_6OC_3F_6H$
$HC_3F_6OCH_3$
$C_5F_{11}OC_2F_4H$
$C_6F_{13}OCF_2H$
$C_6F_{13}OC_2F_4OC_2F_4H$
c-$C_6F_{11}CF_2OCF_2H$
$C_3F_7OCH_2F$
$HCF_2O(C_2F_4O)_n(CF_2O)_mCF_2H$, wherein m=0 to 2 and n=0 to 3
$C_3F_7O[C(CF_3)CF_2O]_pCFHCF_3$, wherein p=0 to 5
$C_4F_9OCF_2C(CF_3)_2CF_2H$
$HCF_2CF_2OCF_2C(CF_3)_2CF_2OC_2F_4H$
$C_7F_{15}OCFHCF_3$
$C_8F_{17}OCF_2O(CF_2)_5H$
$C_8F_{17}OC_2F_4OC_2F_4OC_2F_4OCF_2H$ The omega-hydrofluoroalkyl ethers described by Formula II can be prepared by decarboxylation of the corresponding precursor fluoroalkyl ether carboxylic acids and salts thereof or, preferably, the saponifiable alkyl esters thereof, as described in U.S. Pat. No. 5,658,962, which is herein incorporated by reference. See also Example 1 herein.

Alternatively, the omega-hydrofluoroalkyl ethers can be prepared by reduction of the corresponding omega-chlorofluoroalkyl ethers (for example, those omega-chlorofluoroalkyl ethers described in WO 93/11868 published application), which is also described in U.S. Pat. No. 5,658,962.

The dry cleaning compositions of the invention generally contain greater than about 70 percent by weight HFE, preferably greater than about 75 weight percent HFE, and more preferably greater than about 80 weight percent HFE. Such amounts aid in improved dry times and maintains a high flashpoint.

Cosolvents

The compositions of the invention contain one or more cosolvents. The purpose of a cosolvent in the dry cleaning compositions of the invention is to increase the oil solvency of the HFE. The cosolvent also enables the formation of a homogeneous solution containing a cosolvent, an HFE, and an oil; or a cosolvent, an HFE and an optional detergent. As used herein, a "homogeneous composition" is a single phased composition or a composition that appears to have only a single phase, for example, a solution or a microemulsion.

Useful cosolvents of the invention are soluble in HFEs or water, are compatible with typical dry cleaning detergents, and can solubilize oils typically found in stains on clothing, such as vegetable, mineral, or animal oils, and aqueous-based stains. Any cosolvent or mixtures of cosolvents meeting the above criteria may be used.

Useful cosolvents include alcohols, ethers, glycol ethers, alkanes, alkenes, perfluorocarbons, perfluorinated tertiary amines, perfluoroethers, cycloalkanes, esters, ketones, aromatics, siloxanes, hydrochlorocarbons, hydrochlorofluorocarbons, hydrofluorocarbons, and fluorinated surfactants. Preferably, the cosolvent is selected from the group consisting of alcohols, alkanes, alkenes, cycloalkanes, esters, aromatics, hydrochlorocarbons, and hydrofluorocarbons.

Representative examples of cosolvents which can be used in the dry cleaning compositions of the invention include methanol, ethanol, isopropanol, t-butyl alcohol, methyl t-butyl ether, methyl t-amyl ether, propylene glycol n-propyl ether, propylene glycol n-butyl ether, dipropylene glycol n-butyl ether, propylene glycol methyl ether, ethylene glycol monobutyl ether, 1,2-dimethoxyethane, cyclohexane, 2,2,4-trimethylpentane, n-decane, terpenes (for example, α-pinene, camphene, and limonene), trans-1,2-dichloroethylene, methylcyclopentane, decal in, methyl decanoate, t-butyl acetate, ethyl acetate, glycol methyl ether acetate, diethyl phthalate, 2-butanone, methyl isobutyl ketone, naphthalene, toluene, p-chlorobenzotrifluoride, trifluorotoluene, hexamethyl disiloxane, octamethyl trisiloxane, perfluorohexane, perfluoroheptane, perfluorooctane, perfluorotributylamine, perfluoro-N-methyl morpholine, perfluoro-2-butyl oxacyclopentane, methylene chloride, chlorocyclohexane, 1-chlorobutane, 1,1-dichloro-1-fluoroethane, 1,1,1-trifluoro-2,2-dichloroethane, 1,1,1,2,2-pentafluoro-3,3 -dichloropropane, 1,1,2,2,3-pentafluoro-1,3-dichloropropane, 2,3-dihydroperfluoropentane, 1,1,1,2,2,4-hexafluorobutane, 1-trifluoromethyl-1,2,2-trifluorocyclobutane, 3-methyl-1,1,2,2-tetrafluorocyclobutane, and 1-hydropentadecafluoroheptane.

Another class of compounds that may be used as cosolvents are fluorinated nonionic surfactants, having the tradenames FLUORAD FC-171 and FC-170C, commercially available from Minnesota Mining and Manufacturing Co., St. Paul, Minn., or ZONYL FSO and FSN, commercially available from E.I DuPont de Nemours and Co., Wilmington Del.

The cosolvent is present in the compositions of the invention in an effective amount by weight to form a homogeneous composition with HFE. The effective amount of cosolvent will vary depending upon which cosolvent or cosolvent blends are used and the HFE or blend of HFEs used in the composition. However, the preferred maximum amount of any particular cosolvent present in a dry cleaning composition should not be above the amount needed to make the composition inflammable.

In general, cosolvent may be present in the compositions of the invention in an amount of from about 1 to about 30 percent by weight, preferably from about 5 to about 25 percent by weight, and more preferably from about 5 to about 20 percent by weight.

Water may be present in the compositions of the invention at a level of less than 1 percent by weight of the composition. Generally, the amount of water present in the compositions of the invention is affected by the amount of water present in detergents or other additives. Water may be directly added to the compositions of the invention, if desired. Preferably, the compositions of the invention contain from 0 to less than 1 percent by weight water and more preferably, about 0.1 to less than 1 percent by weight water.

The dry cleaning compositions of the invention may contain one or more optional detergents. Detergents are added to dry cleaning compositions to facilitate the cleaning of aqueous-based stains.

Useful detergents are those which can form a homogeneous solution with HFE and a cosolvent as defined above. These can be easily selected by one of ordinary skill in the art from the numerous known detergents used in the dry cleaning industry.

Examples of preferred commercially available detergents include those having the tradenames VARI-CLEAN, STATICOL and NUTOUCH, commercially available from Laidlaw Corp, Scottsdale, Ariz.; R.R Streets, Naperville, Ill.; and Caled, Wayne, N.J., respectively.

The amount of detergent present in the compositions of the invention is only limited by the compatibility of the detergent. Any desired amount of a detergent may be used provided that the resulting dry cleaning composition is homogeneous as defined above. An effective amount of a detergent is that amount which is compatible with or soluble in either the dispersed or continuous phase. Generally, the detergents may be present in the compositions of the invention in an amount of about 2 percent by weight or less.

The dry cleaning compositions may also optionally contain other additives that would alter the physical properties of the fabric in a desired way, after the cleaning process. These would include materials that would increase the hand, or softness, of the fabric, repellency, etc.

Making Compositions of the Invention

Generally, the cleaning compositions of the invention can be made by simply mixing the components together to form either a solution or a microemulsion.

Generally articles of clothing are cleaned by contacting a sufficient amount of the dry cleaning composition of the invention with the clothing articles for a sufficient period of time to clean the articles or otherwise remove stains. The amount of dry cleaning composition used and the amount of time the composition contacts the article can vary based on equipment and the number of articles being cleaned.

EXAMPLES

Sources, Preparation of Materials Used in Examples

Perfluorobutyl methyl ether ($C_4F_9OCH_3$)—a 20 gallon (3.8 L) Hastalloy C reactor, equipped with stirrer and a cooling system, was charged with 6.0 kg (103.1 mol) of spray-dried potassium fluoride. The reactor was sealed, and the pressure inside the reactor was reduced to less than 100 torr. 25.1 kg of anhydrous dimethyl formamide was then added to the reactor, and the reactor was cooled to below 0° C. with constant agitation. 25.1 kg (67.3 mol) of heptafluorobutyryl fluoride (58 percent purity) was added to the reactor. When the temperature of the contents of the reactor reached −20° C., 12 kg (95.1 mol) of dimethyl sulfate was added to the reactor over a period of approximately 2 hours. The resulting mixture was then allowed to react for 16 hours with continuous agitation, the temperature was raised to 50° C. for an additional 4 hours to facilitate complete reaction, then the temperature was cooled to 20° C. After cooling, volatile material (primarily perfluorooxacyclopentane present in the starting heptafluorobutyryl fluoride reactant) was vented from the reactor over a 3-hour period. The reactor was then resealed and water (6.0 kg) was added slowly to the reactor. After the exothermic reaction of the water with unreacted heptafluorobutyryl fluoride had subsided, the reactor was cooled to 25° C. and the reactor contents were stirred for 30 minutes. The reactor pressure was carefully vented, and the lower organic phase was removed, affording 22.6 kg of material which was 63.2 percent by weight $C_4F_9OCH_3$ (b.p. of 58–60° C., product identity confirmed by GC/MS and by $^1H$ and $^{19}F$ NMR).

| | |
|---|---|
| propylene glycol n-propyl ether | having the tradename DOWANOL PnP ether, commercially available from Dow Chemical Co., Midland, MI |
| propylene glycol n-butyl ether | having the tradename DOWANOL PnB ether, commercially available from Dow Chemical Co. |
| dipropylene glycol n-butyl ether | having the tradename DOWANOL DPnB ether, commercially available from Dow Chemical Co. |
| propylene glycol methyl ether | having the tradename DOWANOL PM ether, commercially available from Dow Chemical Co. |
| propylene glycol methyl ether acetate | having the tradename DOWANOL PMA acetate, commercially available from Dow Chemical Co. |
| ethylene glycol monobutyl ether | having the tradename DOWANOL EB, commercially available from Dow Chemical Co. |
| STATICOL surfactant | commercially available from R. K. Streets, a proprietary detergent formulation used in dry cleaning formulations based on perchloroethylene |
| NU TOUCH surfactant | commercially available from Caled, a proprietary detergent formulation used in dry cleaning formulations based on perchloroethylene |

Test Procedures

Dry Cleaning Simulation Test—a laboratory scale test designed to mimic conditions in a dry cleaning shop, used to evaluate the effectiveness of dry cleaning compositions in removing oil- and water-based stains from fabrics.

Two types of wool fabric were obtained from Burlington Fabrics (Clarksville, Va.)—a peach colored twill and a yellow crepe type fabric. These fabrics were cut into 8 inch by 8 inch (20.3 cm by 20.3 cm) swatches which were challenged with two oil-based stains and two water-based stains. The oil-based stains consisted of 5 drops each of mineral oil, having the tradename KAYDOL, commercially available from Witco Chemical Co., Greenwich, Conn.; and corn oil, having the tradename MAZOLA, commercially available from Best Foods CPC Intl., Inc., Englewood Cliffs, N.J. The water-based stains consisted of 3 drops each of HEINZ ketchup and red wine (Cabernet Sauvignon, E.J. Gallo Wineries, Modesto, Calif.). The stains were each covered with a piece of wax paper, and a five pound weight was applied to each of the stains on the fabric for one minute to simulate grinding the stain into the garment. The weight and wax paper were then removed, and the stained fabric was exposed to ambient air for 20 minutes. The pieces of fabric were then each placed in an 8 ounce (236 mL) glass jar filled with a cleaning solution. Then the jars were capped and shaken for 20 minutes, the fabric swatches were removed, and excess cleaning solution was squeezed out by running the fabric swatch through a roller press. The swatches were then hung in a forced air oven and dried at 160° F. (71° C.) for 15 minutes.

The degree of staining was measured immediately after drying using a compact tristimulus color analyzer, having the tradename MINOLTA 310 Chroma Meter. The reported values in the Tables are an average of three measurements. The analyzer measures the degree of staining as a Delta E ($\Delta E$) value, a mathematical calculation which describes the total color space relative to unstained fabric. The smaller the number, the smaller the difference in color change, that is, the less noticeable the stain. Differences of less than 1 cannot be detected by the human eye.

Comparative Examples C1 and C2

In Comparative Example C1, STATICOL dry detergent, a commercial product sold for use with perchloroethylene in dry cleaning formulations, was added to $C_4F_9OCH_3$ to determine its solubility. This surfactant showed very low solubility in $C_4F_9OCH_3$, indicating that a compatible dry cleaning composition could not be made consisting only of STATICOL surfactant and neat HFE.

In Comparative Example C2, the same solubility experiment was run except that NU TOUCH dry detergent was used in place of STATICOL dry detergent. Again, the surfactant exhibited very low solubility in $C_4F_9OCH_3$, which is undesirable for a dry cleaning composition.

Examples 1–12

The following test was developed to screen useful non-fluorinated cosolvent candidates for use in dry cleaning compositions containing a hydrofluoroether as the major solvent.

Three drops of MAZOLA vegetable oil were added to a small jar containing 30 mL of $C_4F_9OCH_3$. Candidate cosolvents were each added dropwise to the resulting solution. A cosolvent was considered useful if it produced a clear solution when added at a certain minimum percent by weight (even if it produced a cloudy solution at lesser concentrations).

Results from this screening test are shown in TABLE 1.

TABLE 1

Cosolvent Evaluation

| Ex. | Cosolvent Name | % Required to Form a Homogeneous Solution |
|---|---|---|
| 1 | i-propyl alcohol* | 7 |
| 2 | t-butyl alcohol | 7 |
| 3 | ethylene glycol mono-n-butyl ether | 10 |
| 4 | d-limonene | 15–20 |
| 5 | propylene glycol n-propyl ether | 15–20 |
| 6 | propylene glycol n-butyl ether | 15–20 |
| 7 | dipropylene glycol n-butyl ether | 15–20 |
| 8 | dipropylene glycol methyl ether | 15–20 |
| 9 | propylene glycol methyl ether acetate | 15–20 |
| 10 | laurate ester (methyl and isopropyl) | 20 |
| 11 | myristate ester (methyl and isopropyl) | 25 |
| 12 | palmitate ester (methyl and isopropyl) | no single phase |

*Formed an azeotropic composition which was non-flammable even though the alcohol alone was flammable The data in TABLE 1 show that many polar cosolvents gave clear single phases with the $C_4F_9OCH_3$ in the presence of the vegetable oil when employed at concentrations up to about 25 percent by weight, indicating potentially good dry cleaning performance. The compatibility dropped off as the hydrocarbon chain length of the cosolvent increased.

From this study, the propylene glycol alkyl ethers and alkanols were selected for further evaluations in dry cleaning compositions.

Examples 13–20

The amount of each useful cosolvent from TABLE 1 required to make a compatible dry cleaning composition containing $C_4F_9OCH_3$, either STATICOL or NU TOUCH surfactant, and water was next determined.

A STATICOL-based concentrate was formulated which contained 75 g of $C_4F_9OCH_3$, 0.75 g of STATICOL surfactant and 0.8 g of water. A corresponding NU TOUCH-based concentrate was formulated which contained 75 g of $C_4F_9OCH_3$ and 1.0 g of NU TOUCH surfactant (the NU TOUCH surfactant contains some water). The minimum weight percent of each cosolvent required to form compatible mixtures with each concentrate was determined, and the results are presented in TABLE 2.

TABLE 2

Solvent Evaluated for Compatibility:

| Ex. | Cosolvent Name | % for STATICOL | % for NU TOUCH |
|---|---|---|---|
| 13 | i-propyl alcohol | 6 | 10 |
| 14 | t-butyl alcohol | 9 | 10 |
| 15 | propylene glycol methyl ether | 9 | 14 |
| 16 | propylene glycol n-propyl ether | 12 | 14 |
| 17 | propylene glycol n-butyl ether | 12 | 17 |
| 18 | dipropylene glycol n-butyl ether | 14 | 21 |
| 19 | dipropylene glycol methyl ether | 12 | 18 |
| 20 | propylene glycol methyl ether acetate | 27 | 25 |

The data in TABLE 2 show that, in the presence of the surfactant and the small concentration of water, less cosolvent is required to achieve compatibility with the hydrofluoroether, $C_4F_9OCH_3$, than when the cosolvent is used alone with the hydrofluoroether (compared to results in TABLE 1). Also, a higher level of glycol ether acetate (Example 20) was required for compatibility as compared to the alkanols and propylene glycol alkyl ethers of Examples 13–19.

Examples 21–26 and Comparative Examples C1–C2

The Dry Cleaning Simulation Test Procedure was used to evaluate several of the $C_4F_9OCH_3$/cosolvent blends listed in TABLE 1 for removal of ketchup, red wine, mineral oil, and corn oil stains from peach twill. The amount of cosolvent used was the minimum amount listed in Table 1 to produce a homogeneous solution. Also evaluated as comparative examples were $C_4F_9OCH_3$ alone (C1) and perchloroethylene alone (C2).

Average ΔE values for each stain and solvent blend combination are presented in TABLE 3.

TABLE 3

| | | ΔE Value for: | | | |
|---|---|---|---|---|---|
| Ex. | Cosolvent Name | Ketchup | Red Wine | Min. Oil | Corn Oil |
| 21 | propylene glycol n-propyl ether | 22.0 | 3.5 | 0.6 | 1.0 |
| 22 | propylene glycol n-butyl ether | 20.3 | 2.9 | 0.3 | 0.2 |
| 23 | dipropylene glycol methyl ether | 21.4 | 3.6 | 0.2 | 0.2 |
| 24 | propylene glycol methyl ether | 9.8 | 3.2 | 0.4 | 0.3 |
| 25 | i-propyl alcohol | 17.1 | 5.2 | 0.2 | 0.3 |
| 26 | t-butyl alcohol | 18.8 | 4.4 | 0.1 | 3.5 |
| C1 | $C_4F_9OCH_3$ (no cosolvent) | 21.4 | 3.8 | 2.4 | 3.8 |
| C2 | perchloroethylene (no cosolvent) | 22.8 | 2.8 | 0.3 | 0.3 |

The data in TABLE 3 show that the $C_4F_9OCH_3$/cosolvent blends exhibited overall dry cleaning performance equivalent to that of perchloroethylene used alone (that is, generally equivalent in removing oils, slightly superior in removing ketchup, slightly inferior in removing red wine) and superior to that of $C_4F_9OCH_3$ used alone.

Examples 27–32 and Comparative Examples C3–C4

The Dry Cleaning Simulation Test Procedure was used to evaluate several of the $C_4F_9OCH_3$/cosolvent blends listed in TABLE 1 for removal of ketchup, red wine, mineral oil, and corn oil stains from yellow crepe. The amount of cosolvent used was the minimum amount listed in Table 1 to produce a homogeneous solution. Also evaluated as comparative examples were $C_4F_9OCH_3$ (C3) and perchloroethylene (C4).

Average ΔE values for each stain and solvent blend combination are presented in TABLE 4.

TABLE 4

| | | ΔE Value for: | | | |
|---|---|---|---|---|---|
| Ex. | Cosolvent Name | Ketchup | Red Wine | Min. Oil | Corn Oil |
| 27 | propylene glycol n-propyl ether | 19.2 | 3.7 | 0.5 | 0.3 |
| 28 | propylene glycol n-butyl ether | 18.2 | 3.5 | 0.2 | 0.3 |
| 29 | dipropylene glycol methyl ether | 16.8 | 3.6 | 0.6 | 0.4 |
| 30 | propylene glycol methyl ether | 19.7 | 3.4 | 0.3 | 0.3 |
| 31 | i-propyl alcohol | 18.6 | 3.7 | 0.4 | 0.4 |
| 32 | t-butyl alcohol | 20.3 | 3.8 | 0.4 | 0.5 |
| C3 | $C_4F_9OCH_3$ (no cosolvent) | 20.3 | 4.1 | 3.5 | 5.7 |
| C4 | perchloroethylene (no cosolvent) | 15.6 | 4.8 | 0.4 | 0.4 |

The data in TABLE 4 show that the $C_4F_9OCH_3$/cosolvent blends exhibited overall dry cleaning performance equivalent to that of perchloroethylene used alone (that is, generally equivalent in removing oils, slightly superior in removing red wine, slightly inferior in removing ketchup) and superior to that of $C_4F_9OCH_3$ used alone.

Examples 33–38 and Comparative Example C5

The Dry Cleaning Simulation Test Procedure was used to evaluate several of the $C_4F_9OCH_3$/cosolvent/STATICOL surfactant/water blends listed in TABLE 2 for removal of ketchup, red wine, mineral oil and corn oil stains from peach twill. This time the cosolvent was incorporated at a constant 18 percent by weight into each blend, rather than at the concentration shown in TABLE 2. This is the minimum amount of cosolvent required for all of the compositions in TABLE 2 to be homogeneous, and thus could be compared at equal cosolvent amounts. Also evaluated as a comparative example was a standard dry cleaning formulation containing 75 g of perchloroethylene, 0.75 g of STATICOL surfactant and 0.8 g of water (C5).

Average ΔE values for each stain and solvent/surfactant/water blend are presented in TABLE 5.

TABLE 5

| | | ΔE Value for: | | | |
|---|---|---|---|---|---|
| Ex. | Cosolvent Name | Ketchup | Red Wine | Min. Oil | Corn Oil |
| 33 | propylene glycol n-propyl ether | 18.2 | 3.2 | 0.2 | 0.7 |
| 34 | propylene glycol n-butyl ether | 19.8 | 4.1 | 0.2 | 0.5 |
| 35 | dipropylene glycol methyl ether | 19.1 | 3.6 | 0.7 | 0.8 |
| 36 | propylene glycol methyl ether | 7.9 | 4.2 | 0.3 | 0.4 |
| 37 | i-propyl alcohol | 16.5 | 4.6 | 0.1 | 1.7 |
| 38 | t-butyl alcohol | 18.6 | 3.9 | 0.3 | 0.3 |
| C5 | perchloroethylene (no cosolvent) | 19.7 | 3.5 | 0.3 | 0.3 |

The data in TABLE 5 show that the $C_4F_9OCH_3$/cosolvent/STATICOL™ surfactant/water blends exhibited overall dry cleaning performance comparable to that of the perchloroethylene formulation.

Examples 39–44 and Comparative Example C6

The Dry Cleaning Simulation Test Procedure was used to evaluate several of the $C_4F_9OCH_3$/cosolvent/STATICOL surfactant/water blends listed in TABLE 2 for removal of ketchup, red wine, mineral oil and corn oil stains from yellow crepe. Again the cosolvent was incorporated at a constant 18 percent by weight into each blend, rather than at the concentration shown in TABLE 2. This is the minimum amount of cosolvent required for all of the compositions in TABLE 2 to be homogeneous, and thus could be compared at equal cosolvent amounts. Also evaluated as a comparative example was a standard dry cleaning formulation containing 75 g of perchloroethylene, 0.75 g of STATICOL surfactant and 0.8 g of water (C6).

Average ΔE values for each stain and solvent/surfactant/water blend are presented in TABLE 6.

TABLE 6

| | | ΔE Value for: | | | |
|---|---|---|---|---|---|
| Ex. | Cosolvent Name | Ketchup | Red Wine | Min. Oil | Corn Oil |
| 39 | propylene glycol n-propyl ether | 20.6 | 3.7 | 0.4 | 0.6 |
| 40 | propylene glycol n-butyl ether | 20.1 | 4.5 | 0.4 | 0.9 |

TABLE 6-continued

| Ex. | Cosolvent Name | ΔE Value for: Ketchup | Red Wine | Min. Oil | Corn Oil |
|---|---|---|---|---|---|
| 41 | dipropylene glycol methyl ether | 17.9 | 4.1 | 0.3 | 0.4 |
| 42 | propylene glycol methyl ether | 21.9 | 4.3 | 0.5 | 0.6 |
| 43 | i-propyl alcohol | 18.6 | 3.6 | 0.3 | 0.3 |
| 44 | t-butyl alcohol | 19.3 | 4.0 | 0.5 | 0.4 |
| C6 | perchloroethylene (no cosolvent) | 15.1 | 4.3 | 0.3 | 0.5 |

The data in TABLE 6 show that the $C_4F_9OCH_3$/cosolvent/STATICOL surfactant/water blends exhibited dry cleaning performance comparable to that of the perchlorocthylene formulation in cleaning of red wine, mineral oil and corn oil stains and somewhat inferior performance in cleaning of ketchup stains.

Examples 45–50 and Comparative Example C7

The Dry Cleaning Simulation Test Procedure was used to evaluate several of the $C4F_9OCH_3$/cosolvent/NU TOUCH surfactant blends listed in TABLE 2 for removal of ketchup, red wine, mineral oil and corn oil stains from peach twill. Again the cosolvent was incorporated at a constant 18 percent by weight into each blend, rather than at the concentration shown in TABLE 2. This is the minimum amount of cosolvent required for all of the compositions in TABLE 2 to be homogeneous, and thus could be compared at equal cosolvent amounts. Also evaluated as a comparative example was a standard dry cleaning formulation consisting of 75 g of perchloroethylene and 1.0 g of NU TOUCH surfactant (C7).

Average ΔE values for each stain and solvent/surfactant blend are presented in TABLE 7.

TABLE 7

| Ex. | Cosolvent Name | ΔE Value for: Ketchup | Red Wine | Min. Oil | Corn Oil |
|---|---|---|---|---|---|
| 45 | propylene glycol n-propyl ether | 16.4 | 3.7 | 0.3 | 0.3 |
| 46 | propylene glycol n-butyl ether | 17.6 | 3.2 | 0.3 | 0.2 |
| 47 | dipropylene glycol methyl ether | 23.2 | 2.3 | 0.5 | 0.6 |
| 48 | propylene glycol methyl ether | 14.8 | 4.6 | 0.7 | 0.2 |
| 49 | i-propyl alcohol | 20.6 | 4.4 | 0.4 | 0.5 |
| 50 | t-butyl alcohol | 18.6 | 3.3 | 0.3 | 0.3 |
| C7 | perchloroethylene (no cosolvent) | 14.9 | 0.2 | 0.3 | 0.3 |

The data in TABLE 7 show that the $C_4F_9OCH_3$/cosolvent/NU TOUCH surfactant blends exhibited dry cleaning performance comparable to that of the perchloroethylene formulation in cleaning of mineral oil and corn oil stains and somewhat inferior performance in cleaning of ketchup and red wine stains.

Examples 51–56 and Comparative Example C8

The Dry Cleaning Simulation Test Procedure was used to evaluate several of the $C_4F_9OCH_3$/cosolvent/NU TOUCH surfactant blends listed in TABLE 2 for removal of ketchup, red wine, mineral oil and corn oil stains from yellow crepe. Again the cosolvent was incorporated at a constant 18 percent by weight into each blend, rather than at the concentration shown in TABLE 2. This is the minimum amount of cosolvent required for all of the compositions in TABLE 2 to be homogeneous, and thus could be compared at equal cosolvent amounts. Also evaluated as a comparative example was a standard dry cleaning formulation consisting of 75 g of perchloroethylene and 1.0 g of NU TOUCH surfactant (C8).

Average ΔE values for each stain and solvent/surfactant blend are presented in TABLE 8.

TABLE 8

| Ex. | Cosolvent Name | ΔE Value for: Ketchup | Red Wine | Min. Oil | Corn Oil |
|---|---|---|---|---|---|
| 51 | propylene glycol n-propyl ether | 17.0 | 7.3 | 0.2 | 0.4 |
| 52 | propylene glycol n-butyl ether | 17.7 | 4.4 | 0.4 | 0.3 |
| 53 | dipropylene glycol methyl ether | 18.4 | 4.0 | 1.4 | 0.3 |
| 54 | propylene glycol methyl ether | 21.4 | 4.6 | 0.4 | 0.9 |
| 55 | i-propyl alcohol | 19.1 | 3.2 | 1.4 | 0.5 |
| 56 | t-butyl alcohol | 20.4 | 4.4 | 0.4 | 0.6 |
| C8 | perchloroethylene (no cosolvent) | 9.2 | 0.4 | 0.6 | 0.4 |

The data in TABLE 8 show that the $C_4F_9OCH_3$/cosolvent/NU TOUCH surfactant blends exhibited dry cleaning performance comparable to that of the perchloroethylene formulation in cleaning of mineral oil and corn oil stains and inferior performance in cleaning of ketchup and red wine stains.

Examples 57–62 and Comparative Example C9

The Dry Cleaning Simulation Test Procedure was used to evaluate several of the $C_4F_9OCH_3$/cosolvent/STATICOL surfactant/water blends listed in TABLE 2 for removal of ketchup, red wine, mineral oil and corn oil stains from peach twill. This time each cosolvent was incorporated at the same level as shown in TABLE 2 (that is, a sufficient cosolvent level to produce a homogeneous solution). Also evaluated as a comparative example was a standard dry cleaning formulation containing 75 g of perchloroethylene, 0.75 g of STATICOL surfactant and 0.8 g of water (C9).

Average ΔE values for each stain and solvent/surfactant/water blend are presented in TABLE 9.

TABLE 9

| Ex. | Cosolvent Name | ΔE Value for: Ketchup | Red Wine | Min. Oil | Corn Oil |
|---|---|---|---|---|---|
| 57 | propylene glycol n-propyl ether | 19.9 | 2.6 | 0.4 | 0.8 |
| 58 | propylene glycol n-butyl ether | 16.6 | 4.0 | 0.3 | 0.8 |
| 59 | dipropylene glycol methyl ether | 19.4 | 4.0 | 1.2 | 2.1 |
| 60 | propylene glycol methyl ether | 21.8 | 4.9 | 1.3 | 1.2 |
| 61 | i-propyl alcohol | 21.4 | 5.3 | 1.5 | 2.4 |
| 62 | t-butyl alcohol | 23.3 | 4.2 | 0.5 | 0.8 |
| C9 | perchloroethylene (no cosolvent) | 23.5 | 4.2 | 0.4 | 0.5 |

The data in TABLE 9 show that, compared to the perchloroethylene formulation, the $C_4F_9OCH_3$/cosolvent/STATICOL surfactant/water blends were slightly superior at removing ketchup stains, generally comparable at removing red wine and mineral oil stains, and slightly inferior at removing corn oil stains.

Examples 63–68 and Comparative Example C10

The Dry Cleaning Simulation Test Procedure was used to evaluate several of the $C_4F_9OCH_3$/cosolvent/STATICOL surfactant/water blends listed in TABLE 2 for removal of ketchup, red wine, mineral oil, and corn oil stains from yellow crepe. This time each cosolvent was incorporated at the same level as shown in TABLE 2 (that is, a sufficient cosolvent level to produce a homogeneous solution). Also evaluated as a comparative example was a standard dry cleaning formulation containing 75 g of perchloroethylene, 0.75 g of STATICOL surfactant and 0.8 g of water (C10).

Average ΔE values for each stain and solvent/surfactant/water blend are presented in TABLE 10.

TABLE 10

| | | ΔE Value for: | | | |
|---|---|---|---|---|---|
| Ex. | Cosolvent Name | Ketchup | Red Wine | Min. Oil | Corn Oil |
| 63 | propylene glycol n-propyl ether | 19.9 | 4.3 | 0.9 | 0.4 |
| 64 | propylene glycol n-butyl ether | 20.1 | 5.3 | 0.3 | 0.6 |
| 65 | dipropylene glycol methyl ether | 20.3 | 3.8 | 0.2 | 0.8 |
| 66 | propylene glycol methyl ether | 19.1 | 5.9 | 0.9 | 1.0 |
| 67 | i-propyl alcohol | 23.1 | 6.0 | 1.9 | 2.3 |
| 68 | t-butyl alcohol | 20.9 | 5.0 | 0.2 | 0.6 |
| C10 | perchloroethylene (no cosolvent) | 14.3 | 4.0 | 0.5 | 0.5 |

The data in TABLE 10 show that, compared to the perchloroethylene formulation, the $C_4F_9OCH_3$/cosolvent/STATICOL surfactant/water blends were superior at removing ketchup stains, generally slightly inferior at removing red wine and corn oil stains, and generally comparable at removing mineral oil stains.

Examples 69–74 and Comparative Example C11

The Dry Cleaning Simulation Test Procedure was used to evaluate several of the $C_4F_9OCH_3$/cosolvent/NU TOUCH surfactant blends listed in TABLE 2 for removal of ketchup, red wine, mineral oil and corn oil stains from peach twill. This time each cosolvent was incorporated at the same level as shown in TABLE 2 (that is, a sufficient cosolvent level to produce a homogeneous solution). Also evaluated as a comparative example was a standard dry cleaning formulation consisting of 75 g of perchloroethylene and 1.0 g of NU TOUCH surfactant (C11).

Average ΔE values for each stain and solvent/surfactant blend are presented in TABLE 11.

TABLE 11

| | | ΔE Value for: | | | |
|---|---|---|---|---|---|
| Ex. | Cosolvent Name | Ketchup | Red Wine | Min. Oil | Corn Oil |
| 69 | propylene glycol n-propyl ether | 16.6 | 4.3 | 0.3 | 0.3 |
| 70 | propylene glycol n-butyl ether | 14.6 | 4.0 | 0.2 | 0.4 |
| 71 | dipropylene glycol methyl ether | 15.7 | 3.5 | 0.8 | 0.9 |
| 72 | propylene glycol methyl ether | 15.2 | 4.5 | 1.3 | 0.9 |
| 73 | i-propyl alcohol | 14.9 | 5.1 | 0.7 | 2.3 |
| 74 | t-butyl alcohol | 21.0 | 4.8 | 1.0 | 1.9 |
| C11 | perchloroethylene (no cosolvent) | 12.4 | 0.3 | 0.3 | 0.3 |

The data in TABLE 11 show that, compared to the perchloroethylene formulation, the $C_4F_9OCH_3$/cosolvent/NU TOUCH surfactant/water blends were generally somewhat inferior at removing all the stains.

Examples 75–80 and Comparative Example C12

The Dry Cleaning Simulation Test Procedure was used to evaluate several of the $C_4F_9OCH_3$/cosolvent/NU TOUCH surfactant blends listed in TABLE 2 for removal of ketchup, red wine, mineral oil, and corn oil stains from yellow crepe. This time each cosolvent was incorporated at the same level as shown in TABLE 2 (that is, a sufficient cosolvent level to produce a homogeneous solution). Also evaluated as a comparative example was a standard dry cleaning formulation consisting of 75 g of perchloroethylene and 1.0 g of NU TOUCH surfactant (C12).

Average ΔE values for each stain and solvent/surfactant blend are presented in TABLE 12.

TABLE 12

| | | ΔE Value for: | | | |
|---|---|---|---|---|---|
| Ex. | Cosolvent Name | Ketchup | Red Wine | Min. Oil | Corn Oil |
| 75 | propylene glycol n-propyl ether | 19.5 | 5.7 | 1.5 | 0.4 |
| 76 | propylene glycol n-butyl ether | 16.0 | 5.5 | 0.5 | 0.5 |
| 77 | dipropylene glycol methyl ether | 18.2 | 4.6 | 0.5 | 1.1 |
| 78 | propylene glycol methyl ether | 17.6 | 3.8 | 1.8 | 0.6 |
| 79 | i-propyl alcohol | 19.7 | 4.6 | 3.1 | 2.5 |
| 80 | t-butyl alcohol | 24.2 | 5.7 | 1.0 | 2.0 |
| C12 | perchloroethylene (no cosolvent) | 9.0 | 0.4 | 0.7 | 0.5 |

The data in TABLE 12 show that, compared to the perchloroethylene formulation, the $C_4F_9OCH_3$/cosolvent/NU TOUCH surfactant/water blends were generally somewhat inferior at removing all the stains.

What is claimed is:

1. A dry cleaning composition comprising a mixture of:

a) hydrofluoroether;

b) an effective amount of cosolvent to form a homogeneous composition, wherein the cosolvent is selected from the group consisting of alkanols, ethers, glycol ethers, perfluoroethers, perfluorinated tertiary amines, alkanes, alkenes, perfluorocarbons, terpenes, glycol ether acetates, hydrochlorofluorocarbons, hydrofluorocarbons, nonionic fluorinated surfactants, cycloalkanes, ketones, aromatics, siloxanes and combinations thereof; and c) water present in an amount of about 0.1 to less than 1 percent by weight of the total composition.

2. The composition of claim 1, further comprising a detergent.

3. The composition of claim 1, wherein the hydrofluoroether is selected from at least one mono-, di-, or trialkoxy-substituted perfluoroalkane, perfluorocycloalkane, perfluorocycloalkyl-containing perfluroroalkane, or perfluorocycloalkylene-containing perfluoroalkane compound and omega-hydrofluoroalkylethers.

4. The composition of claim 1, wherein the hydrofluoroether is a hydrofluoroether or a combination of hydrofluoroethers having the formula:

$$R_f—(O—R_h)_x$$

wherein:

x is from 1 to about 3;

when x is 1, $R_f$ is selected from the group consisting of linear or branched perfluoroalkyl groups having from 2 to about 15 carbons, perfluorocycloalkyl groups having from 3 to about 12 carbon atoms, and perfluorocycloalkyl-containing perfluoroalkyl groups having from 5 to about 15 carbon atoms;

when x is 2, $R_f$ is selected from the group consisting of linear or branched perfluoroalkanediyl groups or perfluoroalkylidene groups having from 2 to about 15 carbon atoms, perfluorocycloalkyl- or perfluorocycloalkylene-containing perfluoroalkanediyl or perfluoroalkylidene groups having from 6 to about 15 carbon atoms, and perfluorocycloalkylidene groups having from 3 to about 12 carbon atoms;

when x is 3, $R_f$ is selected from the group consisting of linear or branched perfluoroalkanetriyl groups or perfluoroalkylidene groups having from 2 to about 15 carbon atoms, perfluorocycloalkyl- or perfluorocycloalkylene-containing perfluoroalkanetriyl or perfluoroalkylidene groups, having from 6 to about 15 carbon atoms, and perfluorocycloalkanetriyl groups having from 3 to about 12 carbon atoms;

in all cases, $R_f$ can be optionally terminated with an $F_5S$-group;

each $R_h$ is independently selected from the group consisting of linear or branched alkyl groups having from 1 to about 8 carbon atoms, cycloalkyl-containing alkyl groups having from 4 to about 8 carbon atoms, and cycloalkyl groups having from 3 to about 8 carbon atoms;

wherein either or both of the groups $R_f$ and $R_h$ can optionally contain one or more catenary heteroatoms; and wherein the sum of the number of carbon atoms in the $R_f$ group and the number of carbon atoms in the $R_h$ group(s) is greater or equal to 4; and wherein the perfluorocycloalkyl and perfluorocycloalkylene groups contained within the perfluoroalkyl, perfluoroalkanediyl, perfluoroalkylidene and perfluoroalkanetriyl groups can optionally and independently be substituted with, for example, one or more perfluoroalkyl groups having from 1 to about 4 carbon atoms.

5. The composition of claim 1, wherein the hydrofluoroether is a hydrofluoroether or a combination of hydrofluoroethers having the formula:

$$X—R_f'—(O—R_f')_y—O—R''—H$$

wherein:

X is either F or H;

$R_f'$ is a divalent perfluorinated organic radical having from 1 to about 12 carbon atoms;

$R_{f''}$ is a divalent perfluorinated organic radical having from 1 to about 6 carbon atoms:

R" is a divalent organic radical having from 1 to 6 carbon atoms, and preferably, R" is perfluorinated; and y is an integer from 0 to 4;

with the proviso that when X is F and y is 0, R" contains at least one F atom.

6. The composition of claim 1, wherein the glycol ethers are selected from ethylene glycol mono-n-butyl ether, propylene glycol n-propyl ether, propylene glycol n-butyl ether, di-propylene glycol n-butyl ether, di-propylene glycol methyl ether, and mixtures thereof.

7. The composition of claim 1, wherein the alkanols are selected from isopropanol, t-butyl alcohol, and mixtures thereof.

8. The composition of claim 1, wherein the cosolvent is present in an amount of about 1 to about 30 percent by weight.

9. The composition of claim 1, wherein the hydrofluoroether is present in an amount of greater than 70 percent by weight.

10. The composition of claim 1, wherein the hydrofluoroether is n-$C_3F_7OCH_3$, $(CF_3)_2CFOCH_3$, n-$C_4F_9OCH_3$, $(CF_3)_2CFCF_2OCH_3$, n-$C_4F_9OC_2H_5$, $(CF_3)_2CFCF_2OC_2H_5$, $(CF_3)_3COCH_3$, $CH_3O(CF_2)_4OCH_3$, $CH_3O(CF_2)_6OCH_3$, or combinations thereof.

11. The composition of claim 1, wherein the hydrofluoroether has a boiling point of not greater than 121° C.

12. The composition of claim 10, wherein the hydrofluoroether is present in an amount of greater than 75 percent by weight of the composition.

13. The composition of claim 6, wherein the cosolvent is present in an amount of from about 5 to about 25 percent by weight of the composition.

14. The composition of claim 2, wherein the detergent is present in an amount of about 2 weight percent or less of the composition.

15. The composition of claim 1, wherein the hydrofluoroether is $C_4F_9OCH_3$.

16. The composition of claim 15, wherein the cosolvent is selected from glycol ethers glycol ether acetates, alkanols, and mixtures thereof.

17. A dry cleaning composition comprising a mixture of:

a) hydrofluoroether;

b) an effective amount of cosolvent to form a homogeneous composition, wherein the cosolvent is selected from the group consisting of methylene chloride, chlorocyclohexane, 1-chlorobutane and mixtures thereof; and c) water present in an amount of about 0.1 to less than 1 percent by weight of the total composition.

* * * * *

UNITED STATES PATENT AND TRADEMARK OFFICE

CERTIFICATE OF CORRECTION

PATENT NO. : 6,159,917
DATED : December 12, 2000
INVENTOR(S) : Baran, Jimmie R. Jr.

It is certified that error appears in the above-identified patent and that said Letters Patent is hereby corrected as shown below:

Column 2,
Line 21, delete “hydrolluoroether” and insert in place thereof -- hydrofluoroether --.

Column 8,
Line 36, delete “decal in” and insert in place thereof -- decalin --.

Signed and Sealed this

Twenty-first Day of January, 2003

JAMES E. ROGAN
*Director of the United States Patent and Trademark Office*